United States Patent [19]

Rackman

[11] 4,156,527

[45] May 29, 1979

[54] SCORING GAME WITH OPERATIVE PATH AND SWITCHING APPARATUS

[76] Inventor: Michael I. Rackman, 1710 Glenwood Rd., Brooklyn, N.Y. 11230

[21] Appl. No.: 913,750

[22] Filed: Jun. 8, 1978

Related U.S. Application Data

[62] Division of Ser. No. 733,473, Nov. 15, 1976, Pat. No. 4,108,438.

[51] Int. Cl.[2] ..... A63B 71/04; A63F 7/02

[52] U.S. Cl. ..... 273/120 R; 273/120 A

[58] Field of Search ..... 273/284, 109, 86 C, 273/118 R, 120 R; 46/43

[56] References Cited

U.S. PATENT DOCUMENTS

| | | | |
|---|---|---|---|
| 1,167,655 | 1/1916 | Passig | 273/120 R |
| 1,278,203 | 9/1918 | Pierce | 273/118 R |
| 1,422,789 | 7/1922 | Schloth et al. | 273/120 R |
| 2,571,521 | 10/1951 | Barnhart | 273/120 R |
| 2,899,206 | 8/1959 | Carter | 273/120 R |
| 3,048,402 | 8/1962 | Schaper | 273/120 R |
| 3,298,692 | 1/1967 | Glass et al. | 46/42 |
| 3,390,471 | 7/1968 | Godfrey | 273/118 R |
| 3,606,334 | 9/1971 | Pippin | 273/284 |
| 3,758,113 | 9/1973 | Trbovich et al. | 273/120 R |

FOREIGN PATENT DOCUMENTS

| | | | |
|---|---|---|---|
| 1090158 | 3/1955 | France | 273/284 |
| 1457422 | 12/1976 | United Kingdom | 273/246 |

*Primary Examiner*—Richard C. Pinkham
*Assistant Examiner*—Lawrence E. Anderson
*Attorney, Agent, or Firm*—Gottlieb, Rackman & Reisman

[57] ABSTRACT

There is disclosed a board game. The board itself has three tracks with a plurality of interconnecting segments therebetween. A group of switches is provided, each adapted to be placed on the board in the region of one of the interconnecting segments. The switches serve to define an operative path from a start point to a finish point which includes selected segments of the tracks. Each player has a set of value pieces and the players take turns and alternately place their value pieces on random ones of a set of identifiable positions on the tracks. Thereafter, the players take turns and alternately place the switches on the board on a random basis until a complete operative path is defined. A marble is then rolled down the path to expose the values of the player pieces which it passes, and the players add up their respective scores.

30 Claims, 12 Drawing Figures

FIG. 5
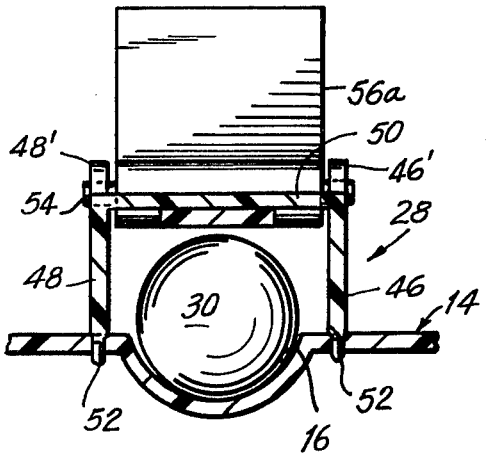
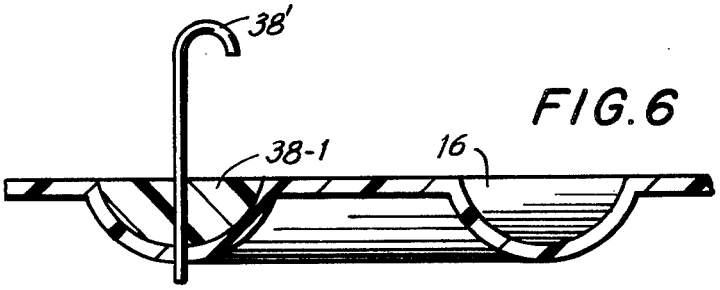
FIG. 6
FIG. 7
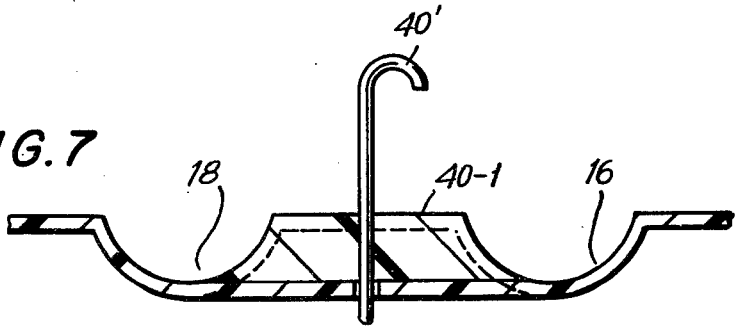
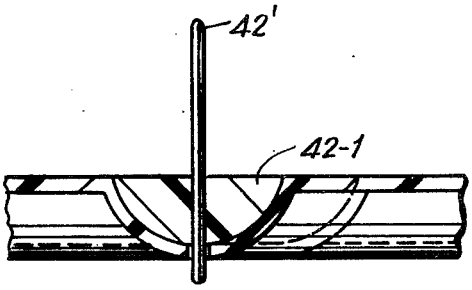
FIG. 8

SCORING GAME WITH OPERATIVE PATH AND SWITCHING APPARATUS

This application is a division of my application Ser. No. 733,473 filed Nov. 15, 1976, entitled "BOARD GAME AND METHOD OF PLAYING SAME", now U.S. Pat. No. 4,108,438.

This invention relates to board games, and more particularly to board games requiring strategic play for winning and which also exhibit action for maintaining player interest.

Games such as chess are of great interest to players, among other reasons, because they require both offensive and defensive strategies. Each player attempts not only to make offensive plays, but also to counter his opponent's offensive plays with defensive moves.

On the other hand, there are many games of the "action" type in which considerable interest is sustained by elements moving on the board, the motion being initiated by the players. For the most part, such games require manual skills rather than strategy.

It is a general object of my invention to provide a board game with unique strategic offensive and defensive moves being required on the part of the players, a game which in its preferred embodiment also exhibits action of the type which sustains player interest.

Briefly, in accordance with the principles of my invention, in the preferred embodiment thereof, a board is provided with a plurality of parallel tracks, the tracks being inclined so that a marble, ball or other spherical object can roll down them. Between the tracks there is a plurality of interconnecting segments. Depending upon the shape of a "switch" which is placed in the region of any interconnecting section, the marble may be controlled to continue to roll along the same track, or to transfer to one of the other tracks.

Each player is provided with a set of player pieces, each having a particular numerical value. Along the tracks there are pre-defined positions on which the player pieces may be placed. Each player piece has its respective value depicted thereon, together with a mechanism for normally hiding the value from view.

In the first step of the game, the players take turns placing their player pieces on the board. The players place their pieces on the board on a random basis. That is, whenever it is the turn of a player, he may place one of his remaining player pieces on any one of the remaining predefined positions. The player pieces in each set are of a respective color. Thus after all of the player pieces are positioned on the board, each player knows where the pieces of the other player are positioned. But because the values of the pieces are hidden from view, neither player knows the values of the other player's pieces.

In the next step, the players take turns placing the switches on the board. The switches ultimately control the path of the marble down the tracks. The switches are also placed on a random basis. The players do not necessarily establish an operative path for the marble in sequence from start to finish. Instead, each player places switches in such a manner that the probability is increased of the marble rolling by his high-value pieces, it being recognized, of course, that there is no assurance that the marble will actually even reach any given switch. During each turn in this step, a player must choose between placing a switch which may result in the marble avoiding a piece of the other player, or placing a switch which directs the marble toward one of his own pieces. During this particular part of the overall game play, each player does not know the value of the other player's pieces; consequently, the emphasis is on offensive moves — each player tries to steer the marble toward his pieces, and particularly his high-value pieces, rather than steering the marble away from the other player's pieces.

After a sufficient number of switches have been placed on the board such that the path of the marble is completely defined, the marble is rolled down the board. As it passes the player pieces along its path, it exposes their values to view. Each player then adds up the values of his exposed pieces to derive his first "partial score."

All of the switches are then removed from the board, and all of the exposed values are covered. The positions of the player pieces are not changed. The players then take turns placing the switches on the board once again. This time, however, the emphasis is not only on offensive moves, but also on defensive moves; each player uses some of his turns to place switches on the board which will steer the marble away from the high-value pieces of the other player of which he now has knowledge. After a complete operative path for the marble is defined by the switches, the marble is allowed to roll down the board a second time and each player computes his second partial score.

In the preferred play of the game, the switches are then removed and the exposed values hidden once again, following which the players take turns placing switches on the board for a third time. During this portion of the play, there are even more defensive moves since each player has learned of still more values of his opponent's pieces as a result of the second roll of the marble. After the third roll, the third partial scores are computed. The winner of the game is the player whose three partial scores up to the highest number.

Further objects, features and advantages of the invention will become apparent upon consideration of the following detailed description in conjunction with the drawing, in which:

FIG. 5 is a sectional view through the line 5—5 of FIG. 4;

FIGS. 6–8 are sectional views through respective lines 6—6, 7—7 and 8—8 of FIG. 3;

Figure 1:
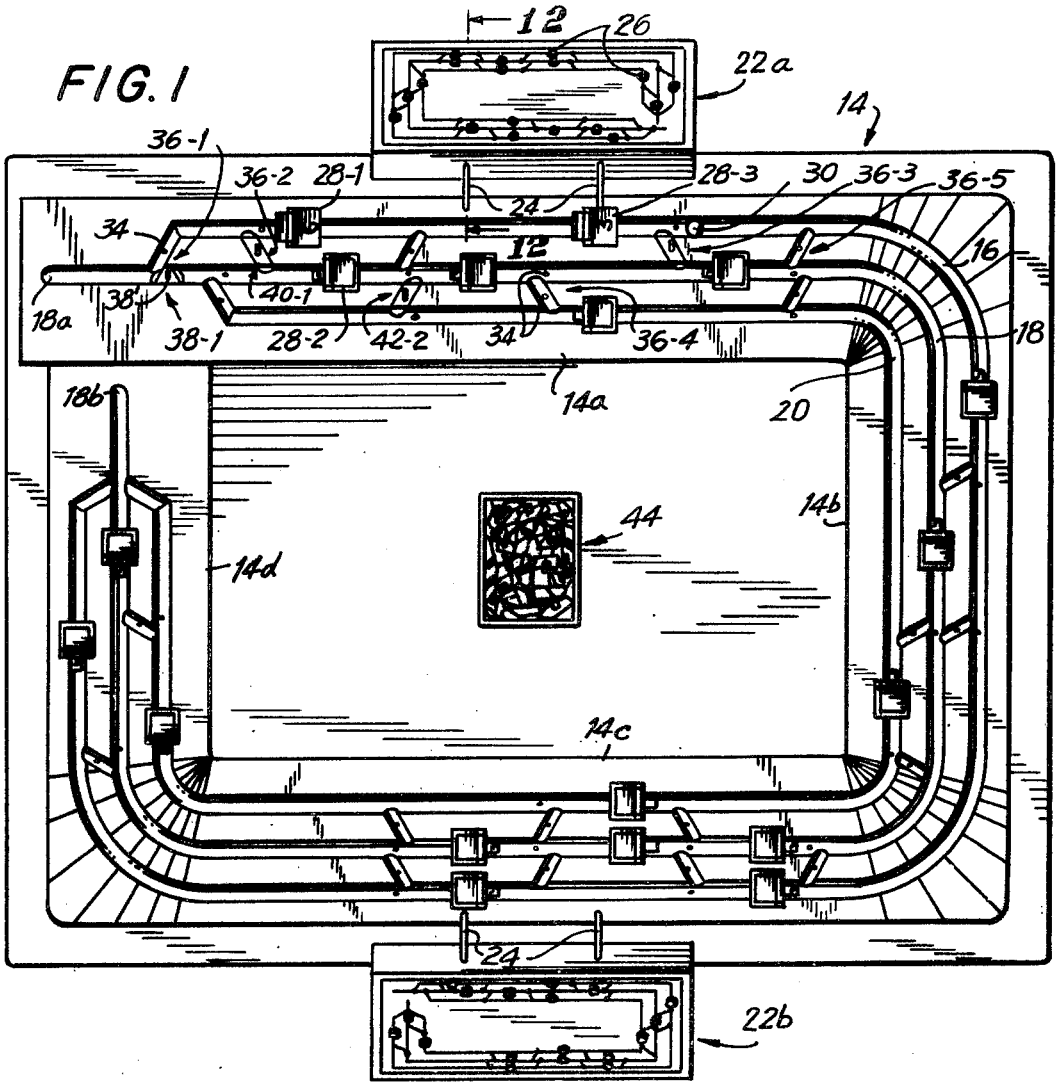
FIG. 1 is a top view of the board showing all of the player pieces in position, but depicting only some of the switches required to define an operative path.
Figure 2:
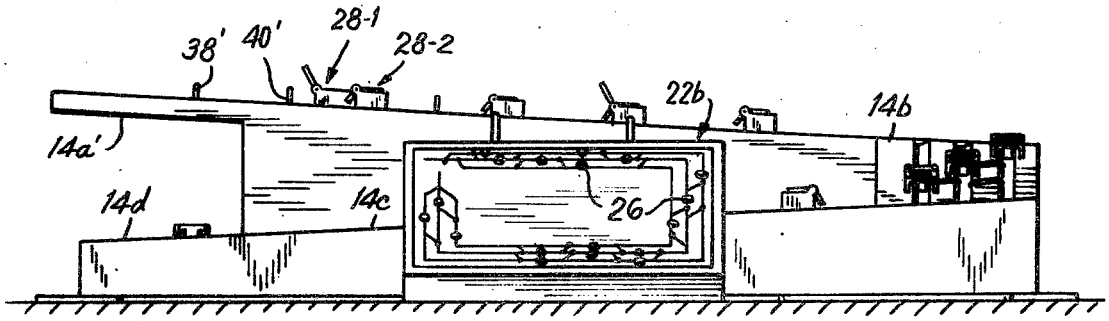
FIG. 2 is a side view of the board as seen from the vantage of one of the players.

Board 14 of FIG. 1 is rectangular in shape and includes four flat sections 14*a–14d*. The four sections of the board are inclined, the uppermost level of the track lay-out being at the left end of section 14*a* (start point 18*a*), and the lowermost level being at the end of section 14*d* (finish point 18*b*). The ball or marble rolls in a clockwise direction (when looking from the top in FIG. 1). As is seen most clearly in FIG. 2, the starting end 14a' of section 14a overhangs the terminal end of section 14d.

In the illustrative embodiment of the invention three parallel tracks 16, 18, 20 are provided on the board, each track being a groove which accommodates a rolling marble 30.

There is a plurality of interconnecting segments between the tracks. Depending upon which switches are placed at the various switch positions, the marble will either continue to roll along the same track or it will transfer to an adjacent track.

The first switch position which the marble reaches is identified by the numeral 36-1. The marble starts to roll from the left end of track 18, the middle track (FIG. 1). Shortly after the marble starts to roll, it reaches switch position 36-1. At this position, a switch 38-1 can be placed, as actually shown in FIG. 1, for blocking further roll of the marble down track 18. In such a case, the marble is diverted to track 16. On the other hand, if instead of placing switch 38-1 on track 18 as shown in FIG. 1, a switch such as switch 42-2 is placed in the first segment which interconnects tracks 16 and 18, the marble will not be diverted from track 18 to track 16, and instead the marble will continue to roll down track 18.

Each switch (see FIGS. 6–11) fits into a groove on the board, and is provided with a hook having an upper portion (38', 40', 42') which can be gripped by a player, the hook extending through the switch to constitute a depending pin. At each switch position such as position 36-1, there is a hole both at the bottom of the track and at the bottom of the interconnecting segment. When placing a switch on the board, its depending pin is placed in one of holes 34 (FIG. 1). This insures that the switches are placed properly so that the end of a switch such as 38-1 is properly positioned so as to deflect the marble to the interconnecting segment, or the end of a switch such as switch 40-1 allows the marble to roll freely past the switch (in this case, past the switch along track 16) without being diverted to the interconnecting segment. At each switch position, only one of the two possible switches may be placed on the board during play of the game. (Were this rule not followed, the marble would come to a complete stop.)

It will be noted that the interconnecting segments have two orientations. The first orientation controls transfer of the marble from an inner track to an outer track (that is, from track 20 to track 18, or from track 18 to track 16). Illustrative switch positions having an interconnecting segment with such an orientation are shown by the numerals 36-1 and 36-5. The other orientation for an interconnecting segment is that which controls movement of the marble from an outer track to an inner track. The interconnecting segments at switch positions 36-2, 36-3 and 36-4 have this type of orientation. In order to control deflection of the marble back and forth along the three tracks, it is actually necessary to employ three types of switches.

Switch type 38 is placed along one of tracks 16, 18 or 20 at any switch position where it is desired to deflect the marble from that track to one of the other tracks. It makes no difference whether the deflection is from an inner track to an outer track, or from an outer track to an inner track. Due to the symmetry of each of switches 38, the same type of switch can be used to control any deflection from one track to another. Referring to FIG. 1, in order to deflect the marble from an inner track to an outer track, the switch is placed in the orientation shown for switch 38-1. On the other hand, suppose that it is desired to place a switch 38 at switch position 36-2 instead of switch 40-1, i.e., to control deflection of the marble from track 16 to track 18 rather than to allow the marble to continue to roll down track 16. In such a case, a switch 38 would be placed to the left of player piece 28-1, but its orientation in FIG. 1 would be opposite that shown for switch 38-1, that is, the long edge of the switch would be along the outer edge of track 16 and the short edge of the switch would be along the inner edge.

Switches 40 and 42 (FIGS. 9 and 10) are the switches which are placed in the interconnecting segments to control continued motion of the marble along a track, i.e., to prevent a deflection from one track to another. As shown in FIG. 1, switches 40-1 and 42-1 are of two different types. Because they are orientated differently in the interconnecting segments, their ends must be shaped differently. Each end of any switch 40 or any switch 42 is shaped so that when it is positioned in an interconnecting segment, the end of the switch actually forms part of the groove to control continued motion of the marble down a track. This is shown most clearly in the perspective view of FIG. 3.

Figure 3:
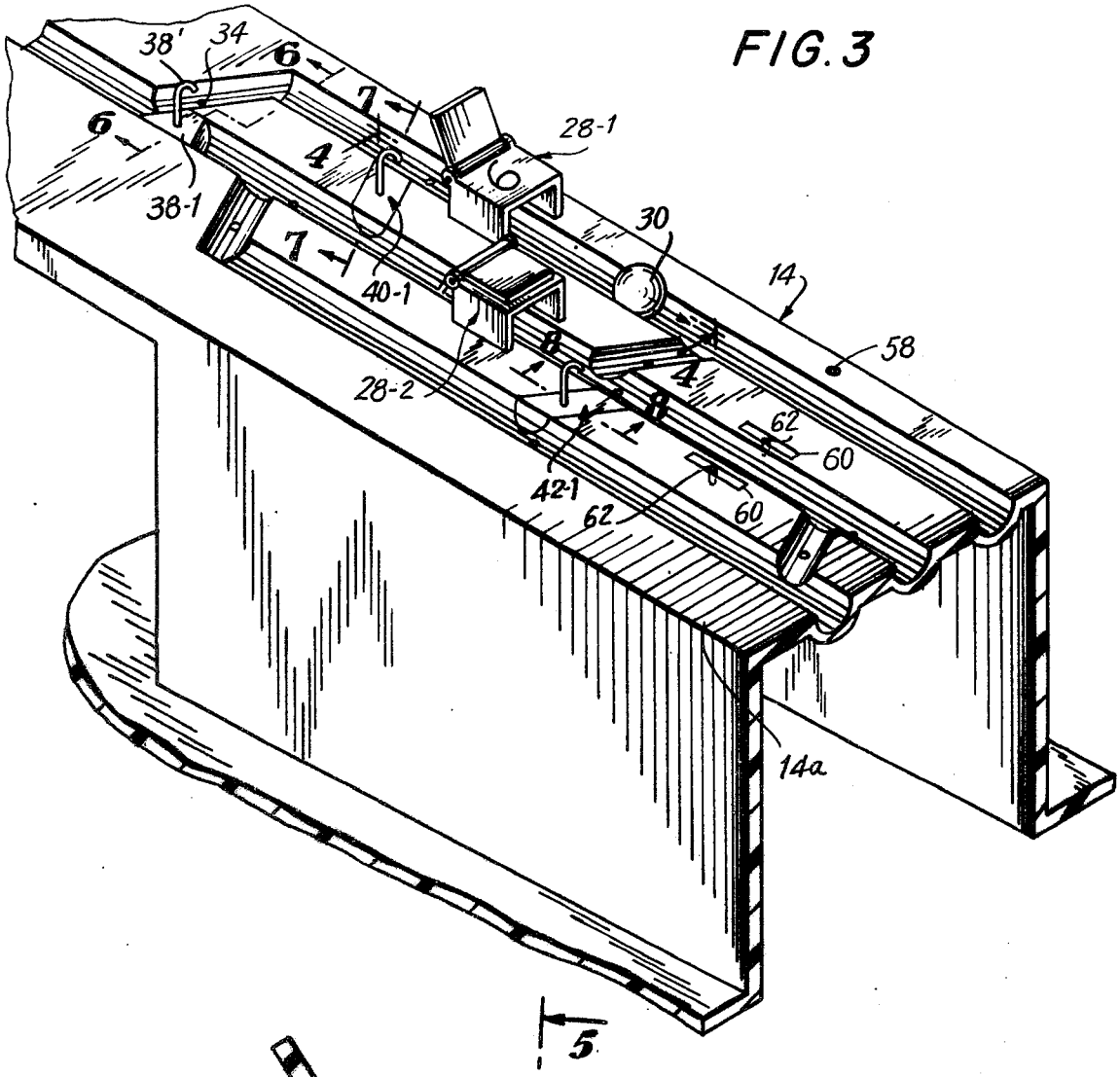
FIG. 3 is an enlarged perspective view of a section of the board.

There are eighteen pre-defined player piece positions which straddle the tracks. Each of these positions is identified by a colored line 60 on either side of the track, as shown in FIG. 3. There is a hole in the middle of each color segment. Each value piece 28 (see FIGS. 3, 4 and 5) includes two sides 46, 48 and a top section 50. The value of the piece is printed on the top of section 50. At the bottom of each of the two sides there is a pin 52. When placing a player piece on a player piece position 60, the two pins 52 are inserted in the two holes 62.

Figure 4:
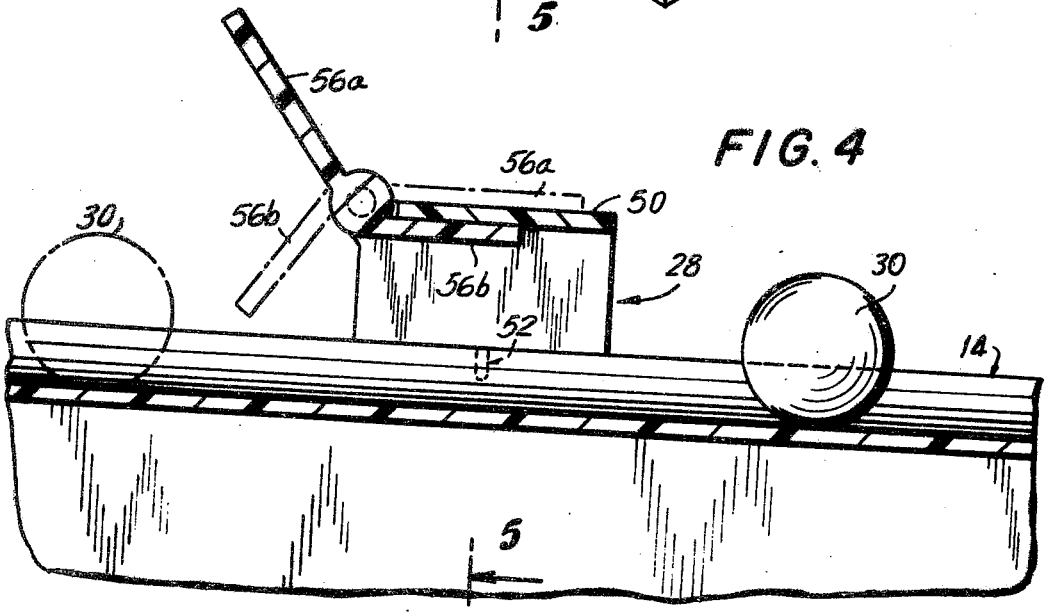
FIG. 4 is a view showing the manner in which the rolling marble exposes the value of a player piece under which it passes.
Figure 9:
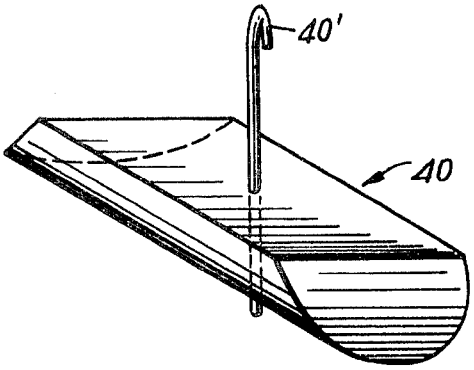
FIGS. 9–11 are perspective views of the switches.
Figure 10:
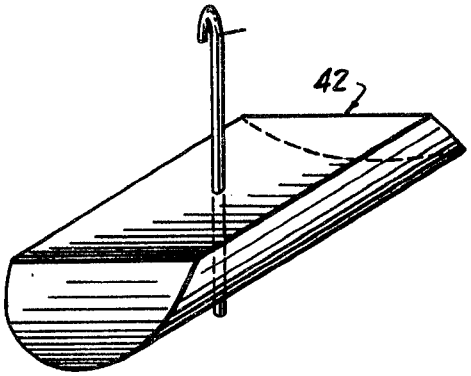

Along one of the upper edges of each player piece, there are two side lugs 46', 48' as shown most clearly in FIGS. 3 and 4. A pin is inserted between the lugs, the pin passing through a flip-flop cover 56. The cover has two sections 56a, 56b, seen most clearly in FIG. 4. When a player piece is positioned on the board, it is positioned such that the end with the pin is the first to be reached by the moving marble, marble 30 in FIG. 4 moving from left to right down the inclined groove. When the piece is first placed on the board, it is placed with section 56a covering top section 50, as shown by the phantom lines in FIG. 4. It is in this way that the value of the piece is covered or hidden from view. When a marble, such as the marble shown in phantom lines in FIG. 4, moves along a groove through a player piece, it hits section 56b of the flip-up cover and causes the flip-flop cover to rotate. By the time the marble has gone through the player piece, as shown by marble 30 in solid lines in FIG. 4, the flip-up cover has been rotated in the counter-clockwise direction and remains in the position shown by the solid lines in FIG. 4. It is in this way that the players can see the value of each player piece through which the marble has passed. FIG. 5 is a view showing the marble within a player piece as it moves along track 16. It is apparent that in order for the marble to move through the player piece, the flip-flop cover must rotate until section 56b bears against the bottom of upper section 50.

The player pieces of the two players have different colors, for example, red and yellow. In the preferred embodiment of the invention, each player has three pieces of value 3, three pieces of value 5, and three pieces of value 7. In order to facilitate the placement of the proper switches in the various switch positions, a color coding may be employed. The three types of switches may be colored differently, for example, white, orange and green. At each switch position, in the regions where the two possible switches may be placed, the grooves are colored to match the colors of the correct switches. Thus if each of switches 38 is white, each switch position will have a white outline along one of the tracks to represent the position of a white switch if it is selected for placement. Similarly, each switch position will have either an orange or green outline in the interconnecting segment to identify the switch whose particular shape is required if it is selected for placement at that switch position. Also, it is preferred to color each of stripes 60 (FIG. 3) with still another color, for example, black, to identify the player piece positions.

Before proceeding to a description of how the game is played, the remaining parts of the game will be described. Referring to FIG. 1, in the center of the board there is a box 44. This box contains all of the switches, of all three types. As the players alternate placing switches on the board, they select them from box 44. Similarly, when the switches are removed from the board after each roll of the marble, they are placed in box 44 preparatory to the next sequence of switch placements on the board.

Figure 12:
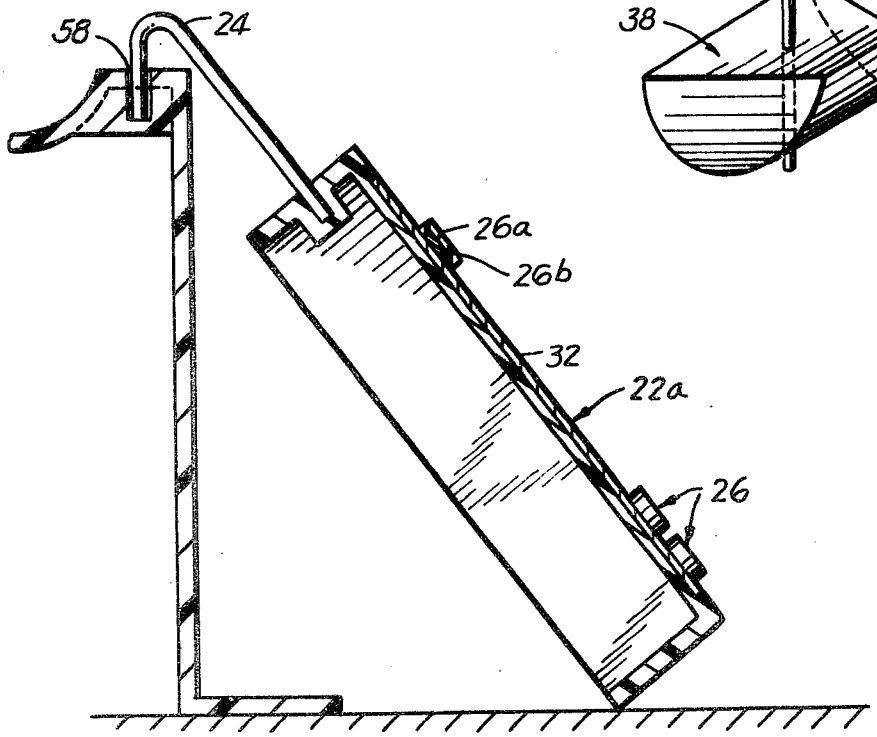
FIG. 12 is a sectional view through the line 12—12 of FIG. 1.
Figure 11:
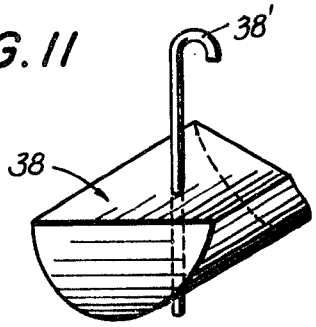

A means is provided to enable each player to remember the value of each of his nine pieces, as well as to record the values of those of his opponent's pieces as he learns them. Each player is provided with a board 22*a* or 22*b* on which there is a simulated track lay-out. Each board has two hooks 24 which fit into the holes 58 (FIGS. 3 and 12) at the top of the board. As seen most clearly in FIG. 12, each player can see only his respective simulated board. The lay-outs on the two boards are mirror images of each other; each lay-out looks exactly like the board, as seen by the respective player.

The lay-out on each board 22*a* or 22*b* is mounted on a thin iron sheet 32. Each player is provided with eighteen discs 26, nine colored red and nine colored yellow. On each of the discs a value is depicted, corresponding to one of the eighteen player pieces. Each disc consists of a plastic housing 26*a* and a small magnet 26*b*, of the type used in magnetic checker sets. In this way, each disc remains in position on a board 22*a*, 22*b* as placed by a player. During the initial phase of the game, as the players take turns in placing their player pieces on the board, when each player places one of his pieces on the board he places the same-value disc of his color on his simulated board so that he will remember the value of his piece. (There are little circles on the faces of boards 22*a*, 22*b* which represent the player piece positions.) As each player learns of the values of his opponent's pieces, corresponding discs (of his opponent's color) are placed on his board 22*a* or 22*b*, so that he can recall these values during succeeding stages of the game.

With this description of the game parts in mind, the actual play of the game will now be described.

The players choose who goes first, and then alternate placing their red and yellow player (value) pieces 28 on the track board, in a random order. Each player piece is placed on the board with its value covered. Whenever a player positions one of his player pieces on the board, he places one of his color discs 26 of the same value on the corresponding position of the track lay-out on his simulated board 22*a* or 22*b*; this allows him to know at all times the value of each of his nine player pieces on the main board, even though the value indicia are covered.

The players then take turns placing the switches 38, 40, 42 on the track board. The player who was second to place a player piece on the board is first to place a switch. At each switch position, only one of the two possible switches may be placed. The switches control the path which the marble will follow along the tracks. The switches may be placed on the board in any random order. As soon as the complete path of the ball is determined by the already placed switches, the players stop placing switches on the board.

The marble is then rolled down the tracks. Whenever it passes under a player piece, the value of that piece is uncovered. Each player adds up the values of all of his uncovered player pieces to derive his first "partial score." After the first roll of the marble, each player knows the values of the other player's pieces which were uncovered, and he places corresponding discs on his simulated board so that he can remember the values of the other player's pieces which were uncovered. All switches are then removed from the tracks and placed in the center in box 44, and all of the exposed player pieces are covered.

The players then take turns again placing the switches on the board. The player with the lowest first partial score goes first. (In the event of equal first partial scores, the player who placed the first switch prior to the first marble roll does so again.) This time, each player tries to insure that the marble will roll under his high-value pieces while avoiding the high-value pieces of the other player which he knows about. As soon as the complete path of the marble is determined by the already placed switches, the marble is rolled down the tracks and each player adds up his second partial score.

If any new information is learned by a player about the values of the other player's pieces, the corresponding discs are placed on the track lay-out on his simulated board. All switches are then removed, and the exposed pieces are covered.

The players then take turns again placing the switches on the tracks. The player with the lowest second partial score goes first. (In case of equal second partial scores, the player who placed the first switch prior to the second roll does so again.) After the marble is rolled down the tracks for the third time, the players compute their third partial scores. Each player then adds up his three partial scores. The player with the highest total score is the winner.

In the illustrative embodiment of the invention the game is played by only two players. It will be apparent, however, that the game may be played by three or more players. In such a case, each player may be provided with a set of player pieces and a simulated board. Similarly, instead of providing a board with three tracks, a board with two, four or more tracks may be provided. However, a board with three tracks has been found to be the most interesting to players.

In the illustrative embodiment of the invention each player piece has a numerical value. If desired, the numerical values in each set may all be different, e.g., one through nine. However, it is better to avoid having too large a difference between the various numerical values because in such a case there is little interest in the low-value pieces. Values of 3, 5 and 7 are preferred, there being three pieces having each of these values for each player in the illustrative embodiment of the invention. Instead of numerical values, it is also possible to use other indicia, for example, alphabet letters. In such a case, the object of the game might be to expose letters which spell out a particular word.

Although it is possible to play the game with only one roll of the ball or marble, the game is most interesting when provision is made for several rolls. This is because as each player learns the values of the other player's pieces, there are many more defensive moves. For example, one of the first moves that a player might take might be to place a switch in a switch position just in front of a high-value piece of the other player to insure that under no circumstances will the marble pass by that piece. Of course, when taking such a defensive move, a player loses the opportunity to take an offensive move, that is, a move which tends to steer the marble toward one of his own high-value pieces.

In the illustrative embodiment of the invention there are twenty-two switch positions. Of course, considerably fewer switches than twenty-two are required to define a complete operative path from start to finish. As a single example, should a player place a switch at position 36-1 (FIG. 1) which causes the marble to continue rolling down track 18 rather than to be deflected to track 16, then there would be no need for either player to place a switch at positions 36-2 and 36-3 since the marble will not even reach these positions during the roll. (If switches were previously placed at positions 36-2 and 36-3, they serve no ultimate purpose after a player places a switch at position 36-1 which controls the marble to continue to roll down track 18.) Depending on the sequence in which the switches are placed on the board by the players, fewer than half of the switch positions may actually have to have switches placed at them in order to completely define the path of the marble.

It is apparent that many different track lay-outs may be devised. In the case of a two-player game, it is desirable to provide at least fourteen player-piece positions and at most twenty. Each player should have at least seven player pieces or else there are not enough player pieces on the board to sustain interest. On the other hand, with more than ten player pieces for each player, the game sometimes "drags out." Similarly, the number of switch positions (inter-connecting segments between the tracks) is variable. There should be at least fifteen or else there is a tendency for the players to start placing switches in sequence from the top of the board toward the bottom, rather than on a random basis. Similarly, the game loses interest if more than thirty switch positions are provided. In the latter case, with so many switch positions, it is relatively easy for each player to steer the marble around most of his opponent's player pieces and the game is low-scoring.

It should be noted that in the illustrative embodiment of the invention the marble can be steered only from one track to an adjacent track. But it is also possible to provide inter-connecting segments between tracks 16 and 20 if desired. In such a case, each interconnecting segment would simply intersect track 18. If the marble is deflected from one of tracks 16 or 20, it will simply roll along the interconnecting segment and cross track 18. On the other hand, if the marble is rolling down track 18, it will simply move through the intersecting interconnecting segment without being diverted.

It is the rolling marble and the flipping up of the player piece covers which provide the "action" in the illustrative embodiment of the invention. But other arrangements are possible. For example, the board may be flat and instead of a rolling marble, a miniature motorized car may be used to follow the defined path. In such a case, the car might pass through player pieces of the type described, or it might move over some other form of player piece which is inserted in the board itself, in the latter case each player piece popping up to expose a value when the car passes over it. Nor is it necessary to provide the particular kinds of switches used in the illustrative embodiment of the invention. For example, at each switch position there may be built into the board a rotatable knob having a neutral position, and two operative positions, each operative position controlling either a continued straight motion (of a marble, car, etc.) or its deflection to an adjacent track.

Instead of "mechanical action," a higher priced version of the game could employ lights. The tracks themselves might comprise electrical conductors, the electrical paths being open-circuited at each switch position. Each player piece might include a bulb therein which is connected in series with a track conductor when the player piece is positioned on the board. The illumination of a bulb might make the value indicia visible to the players. A complete electrical path might be established by employing conductor "bridges" as the switches, one of two possible conductor "bridges" being placed at any selected switch position as the players take turns. If a battery is connected between the start and finish points, as soon as a complete electrical path is established, all of the player pieces along that path would be illuminated and the players could add up their partial scores. The conductor "bridges" would then all be removed prior to the next stage of play.

A cheaper version of the game, with no "action" aspects, might simply include flat rectangles for the player pieces with a value on one side, this one side being placed facing the board when the player piece is first positioned so that the value is hidden. The "switches" might simply be small markers which would indicate, at the switch positions where they are placed, whether the operative path continues in a straight line or makes a deflection. As soon as a complete path is defined, the players would simply trace out the path and turn over all player pieces along the path to see their values. In this version of the game, the board would be printed, and the player pieces and the switches would be simple flat markers.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

What I claim is:

1. A board game comprising a board having a plurality of tracks with a plurality of interconnecting segments therebetween, a plurality of switching means adapted to be placed on the board in the regions of said interconnecting segments for defining an operative path from a start point to a finish point and including selected segments of said tracks and selected ones of said interconnecting segments, said switching means capable of being altered such that various operative paths may be defined, a plurality of identifiable positions along said tracks, and at least two sets of player pieces, for assignment to at least two respective players, each piece having a respective predetermined scoring value said pieces being operatively associated with said tracks for selective placement by at least two respective players on said identifiable positions such that each playing piece is associated with a different position along said tracks during defined intervals of play.

2. A board game in accordance with claim 1 having three tracks, and between fifteen and thirty interconnecting segments therebetween.

3. A board game in accordance with claim 1 wherein said board is rectangular, said tracks are parallel to each other, and said tracks extend along the four edges of the board.

4. A board game in accordance with claim 1 wherein each set of player pieces includes at least seven and at most ten player pieces, each set having the same number of player pieces.

5. A board game in accordance with claim 4 having three tracks, and between fifteen and thirty interconnecting segments therebetween.

6. A board game in accordance with claim 5 wherein said board is rectangular, said tracks are parallel to each other, and said tracks extend along the four edges of the board.

7. A board game in accordance with claim 1 wherein each of said player pieces has an indicia thereon representative of the respective scoring value normally hidden from view and is adapted to expose the indicia responsive to said moving means moving along the track segment on which said each player piece is positioned.

8. A board game in accordance with claim 7 wherein the indicia on each player piece is a numerical value.

9. A board game in accordance with claim 8 further including means for each player having thereon a simulation of said board, and a plurality of marking means for each of said players representative of said player pieces and adapted for placement on the board simulation means of said each player to represent the positions and indicia of the player pieces positioned on said board.

10. A board game in accordance with claim 9 wherein each set of player pieces includes at least seven and at most ten player pieces, each set having the same number of player pieces.

11. A board game in accordance with claim 10 having three tracks, and between fifteen and thirty interconnecting segments therebetween.

12. A board game in accordance with claim 11 wherein said board is rectangular, said tracks are parallel to each other, and said tracks extend along the four edges of the board.

13. A board game in accordance with claim 1 wherein each player piece has a numerical value thereon.

14. A board game in accordance with claim 13 further including means for each player having thereon a simulation of said board, and a plurality of marking means for each of said players representative of said player pieces and adapted for placement on said the board simulation means of said each player to represent the positions and numerical values of the player pieces positioned on said board.

15. A board game in accordance with claim 14 wherein each set of player pieces includes at least seven and at most ten player pieces, each set having the same number of player pieces.

16. A board game in accordance with claim 15 having three tracks, and between fifteen and thirty interconnecting segments therebetween.

17. A board game in accordance with claim 16 wherein said board is rectangular, said tracks are parallel to each other, and said tracks extend along the four edges of the board.

18. A board game in accordance with claim 1 further including means for each player having thereon a simulation of said board, and a plurality of marking means for each of said players representative of said player pieces and adapted for placement on the board simulation means of said each player to represent the positions of the player pieces positioned on said board.

19. A board game in accordance with claim 18 wherein each set of player pieces includes at least seven and at most ten player pieces, each set having the same number of player pieces.

20. A board game in accordance with claim 19 having three tracks, and between fifteen and thirty interconnecting segments therebetween.

21. A board game in accordance with claim 18 wherein said board is rectangular, said tracks are parallel to each other, and said tracks extend along the four edges of the board.

22. A board game in accordance with claim 18 having three tracks, and between fifteen and thirty interconnecting segments therebetween.

23. A board game in accordance with claim 1 further including means for moving along said operative path to identify those of said player pieces which are positioned along said operative path.

24. A board game in accordance with claim 23 wherein said tracks are inclined from said starting point to said finish point at a lower level, said moving means is a rolling ball, and each of said switching means controls said rolling ball either to continue along the same track or to transfer to another track.

25. A board game in accordance with claim 24 wherein each of said player pieces has an indicia thereon representative of the respective scoring value normally hidden from view and is adapted to expose the indicia responsive to said ball rolling along the track segment on which said each player piece is positioned.

26. A board game in accordance with claim 25 wherein the indicia on each player piece is a numerical value.

27. A board game in accordance with claim 26 further including means for each player having thereon a simulation of said board, and a plurality of marking means for each of said players representative of said player pieces and adapted for placement on the board simulation means of said each player to represent the positions and indicia of the player pieces positioned on said board.

28. A board game in accordance with claim 27 wherein each set of player pieces includes at least seven and at most ten player pieces, each set having the same number of player pieces.

29. A board game in accordance with claim 28 having three tracks, and between fifteen and thirty interconnecting segments therebetween.

30. A board game in accordance with claim 29 wherein said board is rectangular, said tracks are parallel to each other, and said tracks extend along the four edges of the board.

* * * * *